US005511833A

United States Patent [19]

Tashman et al.

[11] Patent Number: 5,511,833

[45] Date of Patent: Apr. 30, 1996

[54] LATCHING MECHANISM FOR SLIDING DOORS AND WINDOWS

[75] Inventors: Fred F. Tashman, Scottsdale; Dale L. Bargman, Jr., Gilbert, both of Ariz.

[73] Assignee: Tashco Industries, Inc., Gilbert, Ariz.

[21] Appl. No.: 511,419

[22] Filed: Aug. 4, 1995

[51] Int. Cl.[6] ..... E05C 1/04; E05B 3/00

[52] U.S. Cl. ..... 292/145; 292/102; 292/DIG. 46; 49/449; 49/460; 70/95; 70/97

[58] Field of Search ..... 292/145, 146, 292/150, 302, DIG. 46, 102; 70/95, 96, 97, 98, 99, 100; 49/449, 460, 448

[56] References Cited

U.S. PATENT DOCUMENTS

| | | | |
|---|---|---|---|
| 1,284,741 | 11/1918 | McManus | 292/145 X |
| 2,869,187 | 1/1959 | Liebman et al. | 292/DIG. 46 X |
| 3,050,322 | 8/1962 | Miller | 49/449 |
| 3,266,832 | 8/1966 | Johnston | 292/DIG. 46 X |
| 3,514,904 | 6/1970 | Riegelman | 49/460 |
| 4,106,239 | 8/1978 | Bancroft et al. | 49/449 |
| 4,607,510 | 8/1986 | Shanaan et al. | 70/95 |
| 5,158,329 | 10/1992 | Schlack | 292/87 |
| 5,224,297 | 7/1993 | Watkins | 49/449 |
| 5,421,627 | 6/1995 | Yane | 292/162 |

*Primary Examiner*—Steven N. Meyers
*Assistant Examiner*—Donald J. Lecher
*Attorney, Agent, or Firm*—LaValle D. Ptak

[57] ABSTRACT

A combination handle and latching mechanism for sliding doors and windows includes a section of a first extrusion, in the form of an elongated base member which is secured to the frame. Two spaced angled slots are formed through the base member, with a first end near the frame and a second end located a greater distance from the frame when the base member is secured to the frame. A movable operating member overlies the base member and has rods therethrough and passing through the first and second slots to permit the operating member to be moved from a first position with the rods located in the slots at the end nearest the frame to a second position with the rods located in the slots at a greater distance from the frame to move the operating member from a position near the frame to a position away from the frame. An inwardly turned latching flange extends along one side of the operating member to overlie an outwardly extending flange adjacent the frame. When the operating member is in the first position, the sliding door or window is locked against sliding movement. When the operating member is moved to the second position, the latching flange is pulled away from the frame; so that the sliding door or window may be opened.

22 Claims, 2 Drawing Sheets

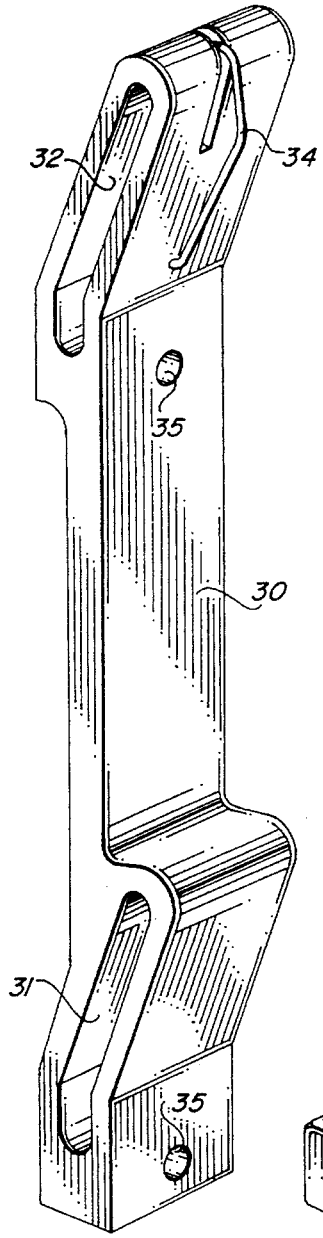
FIG. 4
FIG. 8
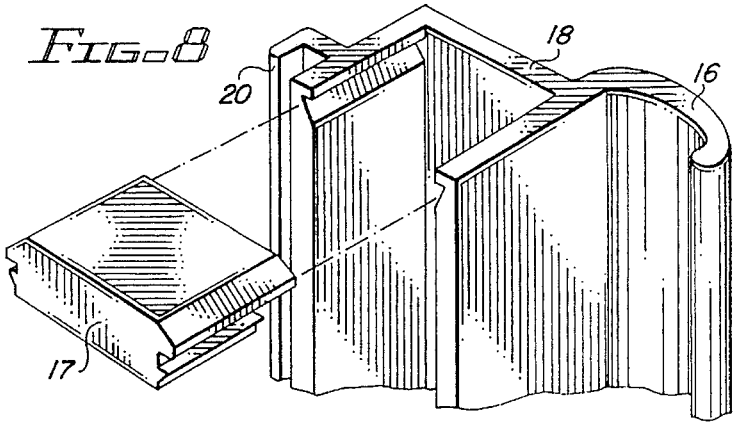
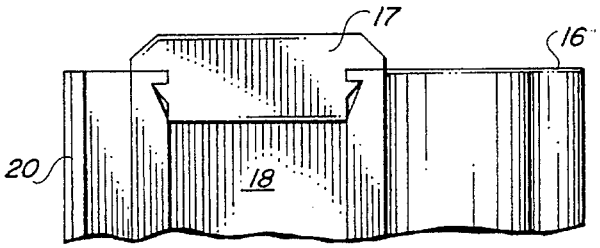
FIG. 9
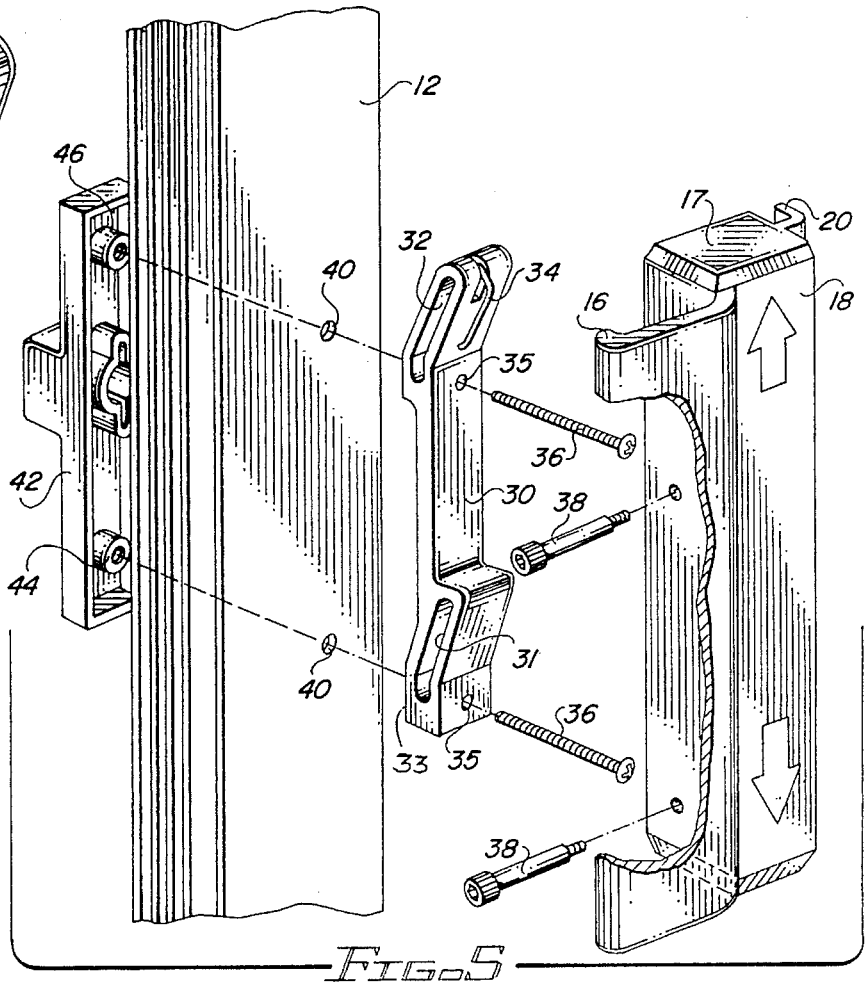
FIG. 5

LATCHING MECHANISM FOR SLIDING DOORS AND WINDOWS

BACKGROUND

Sliding glass doors are widely used in home construction and some commercial installations. In addition, horizontal sliding windows are extensively used in many parts of the United States, particularly in the South and Southwest. Typically, such sliding doors and horizontally sliding windows have a handle on them to facilitate the movement of the door or window. In addition, a separate latching mechanism generally is provided to secure the door or sliding window in the closed position.

Sliding doors which currently are available typically employ one or the other of two different types of latches or locks. One of these locks is a mortise type, which is concealed in the hollow of the stile extrusion, and is connected to the catch by a movable hook. This is a relatively flimsy latching mechanism, because of size constraints which must be employed in the movable hook which is rotated into position by means of a rotating lever mounted on the door. In addition, damage can occur to the catch or opening if the door is forcefully closed when the latching hook is in its "latched" position prior to full closure of the door. This may cause a bending or a breaking of the catch opening and frequently results in failure of the latching mechanism.

Another popular closure latch for use with sliding glass doors is a "clam surface" lock. This lock, again, is operated by a pivoting lever on the door to cause an "L-shaped" latch to pivot toward and away from the door frame. A projection or flange is located on the frame adjacent the location of this pivoting clam lever; so that when the lever is pivoted toward the door to overlie the flange, the door is latched or prevented from being opened. Rotation of the clam latching member outwardly away from the door then clears the flange to permit the door to be opened and closed. Such "clam surface" locks for sliding glass doors generally are preferable to the mortise type discussed above, but still provide a relatively weak latch, because of the restricted area of contact provided by the latching mechanism. In addition, it is necessary to have rotating parts, springs, cams and the like in a multiple part assembly to produce such a pivoting clam surface lock.

For both the mortise type locks and the clam surface locks described above, the locking mechanism is separate from the handle, which is grasped to open and close the door or sliding window. The result is additional cost for the various separate components.

It is desirable to provide an improved latching mechanism for sliding doors and horizontally sliding windows, which is simple and efficient to manufacture and use, and which overcomes the disadvantages of the prior art.

SUMMARY OF THE INVENTION

It is an object of this invention to provide an improved latching mechanism.

It is another object of this invention to provide an improved latching mechanism for sliding doors and sliding windows.

It is an additional object of this invention to provide an improved latching mechanism for sliding doors and windows which combines the latch and handle in a unitary construction.

It is a further object of this invention to provide an improved latching mechanism for sliding doors and windows which combines the latch and handle into a single construction which is easy to operate and to install.

In accordance with a preferred embodiment of this invention, a latching mechanism suitable for use with sliding doors and sliding windows comprises two primary parts. The first of these parts is an elongated base member, which is secured to the frame of a sliding door. The base member has one of a cam surface and a cam follower on it.

The other primary part of the latching mechanism is an elongated movable operating member, which overlies the base member and has the other of the cam surface and the cam follower on it. The cam surface is oriented to cause the operating member to be located near the frame of the door in a first position and to be moved outwardly, away from the frame of the door, in a second position through the interaction of the cam follower and cam surface. The movable operating member further carries an engagement member on it for releasable engagement with a cooperating latch or projection adjacent the sliding door or window.

BRIEF DESCRIPTION OF THE DRAWINGS

FIG. 4 is a perspective view of a portion of the assembly shown in FIG. 1;

FIG. 5 is an exploded view of the assembly shown in FIG. 1;

FIG. 8 is an exploded perspective of a detail of the assembly shown in FIG. 1;

FIG. 9 is an end view of the assembled parts shown in FIG. 8; and

DETAILED DESCRIPTION

Reference now should be made to the drawings, in which the same reference numbers are used throughout the different figures to designate the same components.

Figure 1:
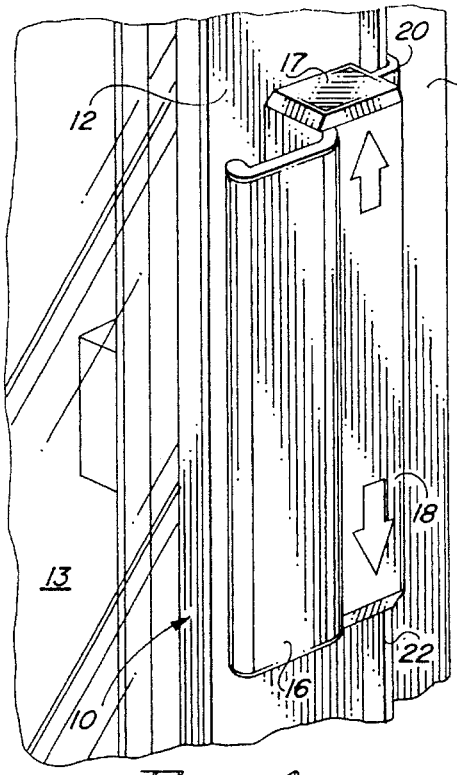
FIG. 1 is a perspective view of an assembly in accordance with a preferred embodiment of the invention.

FIG. 1 is an illustration of a portion of a sliding door 12 and the surrounding frame 14 showing a latching member 10, in accordance with a preferred embodiment of the invention. As illustrated in FIG. 1, the sliding door has a glass panel 13 mounted in it in a conventional fashion. A typical manner of mounting the panel 13 in the door frame 12 is shown in the cross-sectional view of FIGS. 2 and 3.

Figure 3:
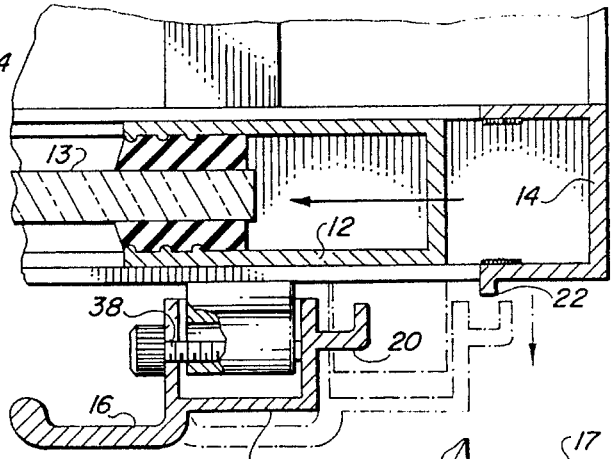
FIG. 3 is a cross-sectional view of a portion of the assembly shown in FIG. 1 in a second position of operation.
Figure 2:
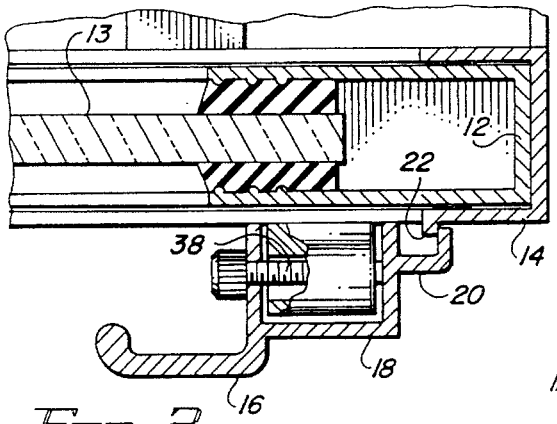
FIG. 2 is a cross-sectional view of a portion of the assembly shown in FIG. 1 in a first position of operation.

In FIG. 1, the latching mechanism comprises an extended handle or grip 16, which is a portion of an extrusion 18 forming a movable operating member having a generally U-shaped cross section, as is most clearly shown in FIGS. 2 and 3. On the side of the operating member 18 opposite the side with the handle 16 is an elongated L-shaped latching lip 20. As is most readily apparent from an examination of FIGS. 2 and 3, the parts 16, 18 and 20 all are part of a unitary, elongated extrusion which is cut to the length shown in FIG. 1 to form the movable operating member and handle/latch combination of the assembly. This extrusion is made of suitable material, such as aluminum or the like, which may be anodized to provide different finish appearances, as desired.

The top and the bottom of the extrusion section, which forms the movable operating member 18, is closed by end caps 17 (shown most clearly in FIGS. 8 and 9), which are undercut to fit into corresponding undercut grooves formed near the ends of the operating member portion 18, as shown in FIGS. 8 and 9. The part 17 is slid into place from left to right (as shown in FIG. 8) to overlie the open end of the channel of the operating member portion 18. When the assembly is in place, as shown in FIG. 1, the top and bottom caps 17 cannot be removed without removing the entire operating member 18 from the assembly in a manner described in greater detail subsequently.

As shown most clearly in FIGS. 4, 5, 6 and 7, the latching mechanism includes a second extruded section 30 (also made of aluminum or the like), which forms a base member. This base member 30 have a rear surface 33 and is secured to the frame or stile 12 of the door (or sliding window, if desired) by means of threaded fasteners or screws 36, which are illustrated in detail in FIGS. 5, 6 and 7. As shown in FIG. 5, these screws 36 may extend through corresponding openings 35 in the base member 30 and through corresponding holes 40 drilled through the frame or stile 12 of the door, to be threaded into corresponding threaded openings 44 and 46 in a handle 42 placed on the outside of the door. If the handle 42 (shown most clearly in FIG. 5) is not employed, however, the screws 36 may simply secure the member 30 to the inside of the sliding door at the frame 12 through threaded holes 40, if desired. Whichever structure is used, however, the base member 30, which comprises an elongated vertically oriented member is secured to the inside of the frame or stile 12 of the door by means of the fasteners 36.

As is shown in all of FIGS. 4, 5, 6 and 7, the base member 30 has a pair of elongated slots 31 and 32 formed through it at opposite ends. These slots operate as cam surfaces and, as is shown most clearly in FIGS. 6 and 7, extend from a lower position located nearest the door frame or stile 12, when the member 30 is installed, to an upper position which is located a greater distance away from the surface of the stile or frame 12. The upper slot 32 has an elongated wire retaining spring 34 located in it; and this spring is shown clearly in all of FIGS. 4, 5, 6 and 7.

Figure 6:
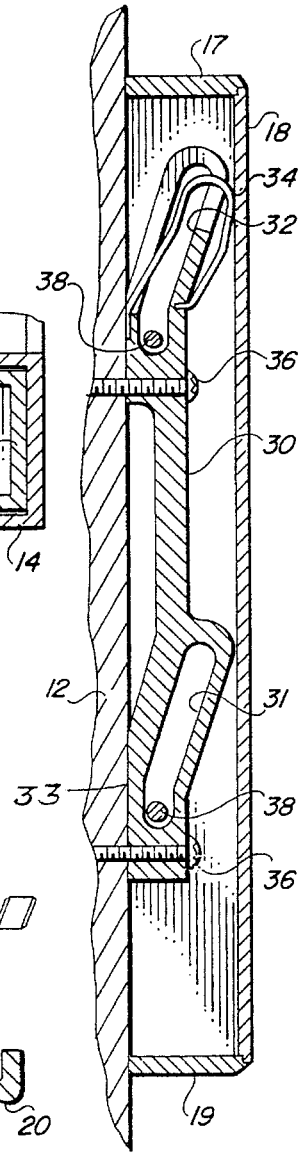
FIG. 6 is a cross-sectional view of the assembly in the operating position of FIG. 2.

Once the base member 30 is secured to the door frame or stile 12, the movable operating member 18 then is placed over the member 30 in the position shown in FIG. 6, and as indicated by the exploded view of FIG. 5. A pair of threaded shafts or rods 38 then are inserted through holes formed through the left-hand side of the elongated operating member 18, as shown most clearly in FIG. 5, and are threaded into receiving threaded recesses (not shown) on the opposite wall, as indicated in FIGS. 2, 3 and 5. The shafts 38 extend into the slots 31 and 32, as shown in FIGS. 6 and 7; so that the movable operating member 16/18/20 is movably secured onto the base member 30 by means of the threaded shafts 38.

As indicated by the arrows in FIGS. 1 and 5, the handle/operating member 18 may be moved up and down, in the direction of the arrows, sliding the shafts or rods 38, which act as cam followers in the cam slots 31 and 32. In the lower position shown in FIG. 6, the lip 20 overlies an elongated flange 22, which vertically runs the length of the fixed frame adjacent the door 12/13. The flange 22 is secured to a receiving frame portion 14, in turn attached to the wall of the opening in which the door 12/13 is installed. This elongated flange 22 is shown most clearly in FIGS. 1, 2 and 3. When the handle/operating member 16/18/20 is in the position indicated by the lowermost or "down" arrow, and as shown in FIGS. 2 and 6, the door is latched against movement toward the left, as viewed in FIGS. 1, 2 and 3, because of the overlapping relationship of the elongated L-shaped latch lip 20 and the flange 22.

Figure 7:
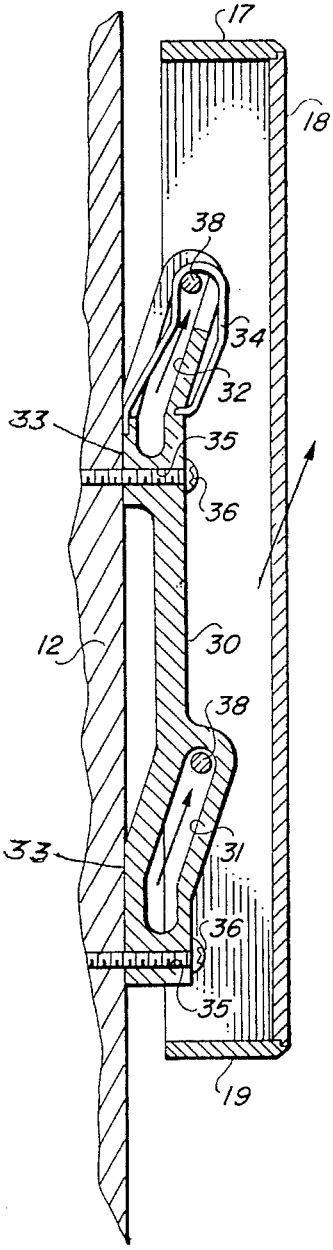
FIG. 7 is a cross-sectional view of the assembly in the operating position shown in FIG. 3.

When the movable operating handle member 18 is pushed upwardly in the direction of the "up" arrow shown in FIGS. 1 and 5, the cam follower shafts or rods 38 ride upwardly in the slots 31 and 32 to the position shown in FIG. 7 (and indicated in cross section in FIG. 3). As illustrated, this moves the combined handle and operating lever, as well as the L-shaped latch lip 20, upwardly and outwardly away from the door frame stile 12 to a position where the L-shaped latch lip 20 is moved outwardly away from the flange 22 a sufficient distance to permit the door to be moved to the left to the position shown in FIG. 3. The spring 34 functions to hold the upper shaft 38 in the uppermost position; so that the handle operating member 16/18 remains in the upper position shown in FIG. 7 as retained by the spring until it is pushed downwardly, as illustrated in the various figures of the drawing, to the closed or latched position of FIGS. 1, 2 and 6. When this is done, the parts assume the relative positions shown in these figures and the door is securely latched closed.

If the movable operating member 18 is moved from its uppermost vertical position, shown in FIG. 7, to the lowermost position shown in FIG. 6 while the door 12/13 is open and a subsequent effort is made to close the door, the outside edge of the latch lip 20 will contact the left-hand edge of the vertical flange 22 on the fixed frame around the door and prevent the door from being fully closed. Because the elongated latch lip 20 is the same length as the door handle and operating member 18 (approximately six inches), this attempt to close the door when the latch mechanism is in its "closed" position does not result in any damage to the latch, since the shock of such an attempted closure is distributed over a relatively wide area. Whenever the operator notices that an attempt is made to close the door with the latch in its downward or latched position, it is a simple matter to push the latch upwardly in the direction of the "up" arrow to place it in the position shown in FIGS. 3 and 7. Then full closure of the door to the position shown in FIG. 2 may be accomplished; whereupon the latch may be moved to the downward position to lock the door, as shown in FIGS. 2 and 6.

Figure 10:
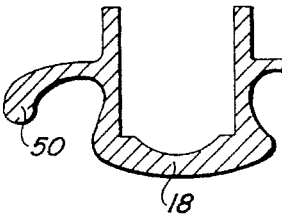
FIGS. 10 and 11 show alternative variations of a portion of the assembly shown in FIGS. 1 to 3 and 5 to 9.
Figure 11:
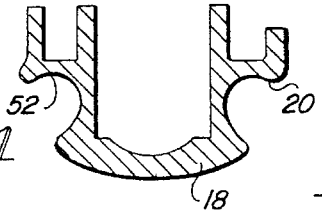

FIGS. 10 and 11 show cross sections of extrusions which may be utilized in place of the extrusions 16/18/20 shown in cross section in FIGS. 2 and 3 for the combination handle/operating member and latch. The basic configurations of the extrusions shown in FIGS. 10 and 11 comprise a hollow operating member portion 18 and an L-shaped portion 20 similar to the portions 18 and 20 shown in the extrusion of FIG. 3; although there are slight shape variations, which are readily apparent from a comparison of the different cross sections. The handle portion 16, however, has been changed to an outwardly turned handle 50 in the extrusion of FIG. 10. In FIG. 11, an extension 52 is utilized to provide a symmetrical look to the overall handle 52/18/20 when this configuration is used. It is readily apparent that other variations of extrusion cross sections may be employed to provide the composite handle/operating lever and latch, as desired, to obtain different appearances to the device. In all other respects, extrusions of the type shown in FIGS. 10 and 11 operate in the same manner as the extrusion 16/18/20 shown in FIGS. 1 to 3 and 5 through 9 of the embodiment described above.

The foregoing description of the preferred embodiment of the invention should be considered as illustrative and not as limiting. Various changes and modifications may be made to perform substantially the same function, in substantially the same way, to achieve substantially the same result by those skilled in the art, without departing from the true scope of the invention as defined in the appended claims.

What is claimed is;

1. A latching mechanism for sliding doors and windows including in combination:

an elongated base member having a rear surface adapted to be secured to a frame and having one of a cam surface and a cam follower on it;

a movable operating member having a generally U-shaped cross section overlying said base member with the other of said cam surface and said cam follower on it, said operating member being movable longitudinally relative to said base member from a first position to a second position with said cam and said cam follower causing said operating member to move toward and away from said rear surface of said base member as said movable operating member is moved between said first and second positions relative to said base member; and an engagement member on said movable operating member for releasable engagement with a cooperating latch part adjacent said base member.

2. The combination according to claim 1 wherein said cam surface is on said base member and said cam follower is on said movable operating member.

3. The combination according to claim 2 wherein said movable operating member comprises a combined handle and latching member.

4. The combination according to claim 3 wherein said base member is formed from a section of a first extrusion and said movable operating member is formed from a section of a second extrusion.

5. The combination according to claim 4 wherein said engagement member comprises an elongated flange attached to said movable operating member and having an L-shaped cross section with the open end thereof facing said base member, when said base member is attached to a frame.

6. The combination according to claim 1 wherein said movable operating member comprises a combined handle and latching member.

7. The combination according to claim 1 wherein said base member is formed from a section of a first extrusion and said movable operating member is formed from a section of a second extrusion.

8. The combination according to claim 1 wherein said engagement member comprises an elongated flange attached to said movable operating member and having an L-shaped cross section with the open end thereof facing said base member, when said base member is attached to a frame.

9. A latching mechanism for sliding doors and windows including in combination;

an elongated base member having a rear surface adapted to be secured to a frame, said base member having at least one elongated cam slot therein, said slot having first and second ends, with said first end thereof located nearer the rear surface of said base member than said second end thereof when said base member is secured to a frame;

an elongated movable operating member overlying said base member and having a cam follower projection attached thereto extending into said slot in said base member, said operating member being longitudinally movable relative to said base member from a first position, with said projection at said first end of said slot in said base member, to second position with said projection at said second end of said slot to move said operating member from a first position near the rear surface of said base member to a second position spaced a predetermined distance away from the rear surface of said base member; and an engagement member on said movable member for engagement with a cooperating latch part mounted adjacent said base member with said movable operating member in said first position thereof and released from engagement with said movable operating member in said second position thereof.

10. The combination according to claim 9 wherein said base member is adapted to be vertically secured to a frame of sliding doors and windows, with said first end of said slot comprising a lower end and the second end of said slot comprising the upper end thereof when said base member is secured to a frame.

11. The combination according to claim 10 further including a retention spring in said slot for retaining said cam follower projection in said slot in said second position when said movable operating member is moved to said second position relative to said base member.

12. The combination according to claim 11 wherein said movable operating member comprises a combined handle and latching member.

13. The combination according to claim 12 wherein said base member is formed from a section of a first extrusion and said movable operating member is formed from a section of a second extrusion.

14. The combination according to claim 9 wherein said base member has two parallel spaced cam slots therein extending through said base member, and said cam follower projection on said movable operating member includes first and second rods attached thereto and extending through said first and second slots.

15. The combination according to claim 14 wherein said first and second rods are releasably attached to said movable operating member to removably secure said movable operating member in position overlying said base member.

16. The combination according to claim 15 wherein said movable operating member is movable in a direction perpendicular to the axis of said first and second rods.

17. The combination according to claim 16 wherein said base member is adapted to be vertically secured to a frame of sliding doors and windows, with said first end of said slot comprising a lower end and the second end of said slot comprising the upper end thereof when said base member is secured to a frame.

18. The combination according to claim 17 wherein said movable operating member is in the form of an elongated extrusion having a generally U-shaped cross section, the open side of which is located overlying said base member.

19. The combination according to claim 14 wherein said engagement member comprises an elongated flange attached to said movable operating member and having an L-shaped cross section with the open end thereof facing said base member, when said base member is attached to a frame.

20. The combination according to claim 19 wherein said cooperating latch part comprises an elongated rib.

21. The combination according to claim 9 wherein said movable operating member comprises a combined handle and latching member.

22. The combination according to claim 9 wherein said movable operating member is in the form of an elongated extrusion having a generally U-shaped cross section, the open side of which is located overlying said base member.

* * * * *